US011142860B2

(12) United States Patent
Choi et al.

(10) Patent No.: US 11,142,860 B2
(45) Date of Patent: Oct. 12, 2021

(54) WASHING MACHINE AND CONTROL METHOD THEREOF

(71) Applicant: Samsung Electronics Co., Ltd., Suwon-si (KR)

(72) Inventors: Jung Chul Choi, Hwaseong-si (KR); Jun Hyun Park, Hwaseong-si (KR); Wan Hee Lee, Seongnam-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 157 days.

(21) Appl. No.: 16/324,513

(22) PCT Filed: Jul. 3, 2017

(86) PCT No.: PCT/KR2017/007033
§ 371 (c)(1),
(2) Date: Feb. 8, 2019

(87) PCT Pub. No.: WO2018/030640
PCT Pub. Date: Feb. 15, 2018

(65) Prior Publication Data

US 2019/0169779 A1 Jun. 6, 2019

(30) Foreign Application Priority Data

Aug. 8, 2016 (KR) ..... 10-2016-0100818

(51) Int. Cl.
*D06F 37/38* (2006.01)
*D06F 33/00* (2020.01)
(Continued)

(52) U.S. Cl.
CPC ..... *D06F 37/38* (2013.01); *D06F 23/02* (2013.01); *D06F 33/00* (2013.01); *D06F 34/22* (2020.02);
(Continued)

(58) Field of Classification Search
CPC ..... D06F 37/38; D06F 37/306; D06F 34/22; D06F 34/18; D06F 23/02; D06F 33/00;
(Continued)

(56) References Cited

U.S. PATENT DOCUMENTS

| | | | |
|---|---|---|---|
| 2006/0112496 | A1 | 6/2006 | Kim |
| 2010/0242186 | A1 | 9/2010 | Kim et al. |
| 2012/0222222 | A1 | 9/2012 | Chae et al. |

FOREIGN PATENT DOCUMENTS

| | | | |
|---|---|---|---|
| CN | 102301053 | A | 12/2011 |
| CN | 103403244 | A | 11/2013 |
| DE | 10054947 | A1 | 5/2002 |
| EP | 2910673 | A2 | 8/2015 |

(Continued)

OTHER PUBLICATIONS

JP2011245268A—Machine translation (Year: 2011).*

(Continued)

*Primary Examiner* — Tinsae B Ayalew

(57) ABSTRACT

There is proposed a washing machine and a control thereof capable of maximizing a mechanical force regardless of the amount and weight of laundry. By using a washing profile in which the cycle and size of a washing RPM are variable, a washing mechanical force can be maximized regardless of the amount of laundry or a change in the weight of the laundry due to moisture absorption of the laundry. In addition, the head drop behavior of the laundry can be diversified through the washing profile in which the cycle and size of the washing RPM are variable, and in this way, by allowing water (washing water) to be effectively infiltrated into the laundry, the washing performance can be improved. In addition, by continuously showing various washing operations (rubbing, tapping, centrifugal rotation, or the like), an effect of enhancing the visibility of washing can be obtained.

19 Claims, 16 Drawing Sheets

(51) Int. Cl.

| | |
|---|---|
| ***D06F 34/22*** | (2020.01) |
| ***D06F 23/02*** | (2006.01) |
| ***D06F 37/30*** | (2020.01) |
| *D06F 35/00* | (2006.01) |
| *D06F 34/18* | (2020.01) |
| *D06F 103/00* | (2020.01) |
| *D06F 103/34* | (2020.01) |
| *D06F 103/44* | (2020.01) |
| *D06F 105/46* | (2020.01) |

(52) U.S. Cl.
CPC ..... *D06F 37/306* (2013.01); *D06F 34/18* (2020.02); *D06F 35/005* (2013.01); *D06F 2103/00* (2020.02); *D06F 2103/34* (2020.02); *D06F 2103/44* (2020.02); *D06F 2105/46* (2020.02)

(58) Field of Classification Search
CPC ..... D06F 2105/46; D06F 2103/00; D06F 2103/34; D06F 2103/44; D06F 35/005
USPC ..... 68/12.04
See application file for complete search history.

(56) References Cited

FOREIGN PATENT DOCUMENTS

| | | | |
|---|---|---|---|
| JP | 2011-072459 | A | 4/2011 |
| JP | 2011245268 | A | 12/2011 |
| JP | 2013-027449 | A | 2/2013 |
| JP | 2016-077622 | A | 5/2016 |
| KR | 10-0315812 | B1 | 12/2001 |
| KR | 10-2011-0033910 | A | 4/2011 |

OTHER PUBLICATIONS

ISA/KR, "International Search Report and Written Opinion of the International Searching Authority," International Application No. PCT/KR2017/007033, dated Oct. 19, 2017, 28 pages.
Extended European Search Report dated Jun. 17, 2019 regarding Application No. 17839658.6, 7 pages.
Communication pursuant to Article 94(3) EPC dated Apr. 23, 2020 in connection with European Patent Application No. 17 839 658.6, 6 pages.
Office Action dated Nov. 4, 2020 in connection with Chinese Patent Application No. 201780061502.7, 16 pages.
The Second Office Action dated May 18, 2021 in connection with Chinese Application No. 201780061502.7, 9 pages.

* cited by examiner

WASHING MACHINE AND CONTROL METHOD THEREOF

CROSS-REFERENCE TO RELATED APPLICATIONS

This application is a 371 National Stage of International Application No. PCT/KR2017/007033, filed Jul. 3, 2017, which claims priority to Korean Patent Application No. 10-2016-0100818, filed Aug. 8, 2016, the disclosures of which are herein incorporated by reference in their entirety.

BACKGROUND

1. Field

The present disclosure relates to a washing machine and a control method thereof capable of maximizing a mechanical force regardless of the amount and weight of laundry.

2. Description of Related Art

A washing machine (e.g., a drum washing machine) includes a tub configured to hold water (washing water or rinsing water), a drum rotatably installed inside the tub to accommodate laundry, and a motor configured to generate a driving force for rotating the drum. The motor rotates the drum in forward and reverse directions at a predetermined washing rotations-per-minute (RPM), and dirt is removed from the laundry inside the drum using a mechanical force (head drop behavior) with which the laundry therein is lifted and dropped along an inner wall of the drum.

Conventionally, as illustrated in FIG. 1, a drum is rotated in forward and reverse directions using a fixed washing RPM (X2, about 45 to 50 RPM), and washing is performed by generating a mechanical force with which laundry is dropped according to the forward and reverse rotations of the drum. When the washing RPM (X2) for generating the mechanical force is fixed, the mechanical force applied to the laundry may vary according to the amount and weight of the laundry.

Generally, according to materials of laundry (W), the weight of laundry (W) changes (increases) in a process in which moisture is absorbed into the laundry (W). Therefore, when washing is performed using a fixed washing RPM (X2), because the weight of the laundry (W) increases due to moisture absorption of the laundry (W), the head drop behavior of the laundry (W) decreases (see FIG. 2B) as compared with the initial stage of washing (see FIG. 2A) such that a mechanical force applied to the laundry is decreased, and washing performance is degraded.

Accordingly, in order to maximize the mechanical force applied to the laundry, a washing RPM of a motor has to be adjusted differently according to the weight of the laundry. To this end, the weight of laundry should be accurately detected, and the optimal washing RPM suitable for the weight of the laundry should be identified.

SUMMARY

However, in detecting the weight of laundry, due to an occurrence of weight detection error caused by physical influences such as contact friction of the laundry and mechanical vibration and electrical influences such as a change in a source voltage, it is difficult to accurately detect the weight of laundry. Also, when a user has put a wet cloth, instead of a dry cloth, in a washing machine, as a result of weight detection, a load amount that is greater than the actual amount of laundry is erroneously detected. Accordingly, not only is it difficult to identify an optimal washing rotations-per-minute (RPM), but also a complex process is necessary in order to identify the optimal washing RPM.

In order to address the above-described problems, an aspect of the present disclosure proposes a washing machine and a control thereof capable of maximizing a washing mechanical force using a washing profile in which the cycle and size of a washing RPM are variable.

To this end, one aspect of the present disclosure proposes a control method of a washing machine including a tub configured to accommodate water, a drum rotatably installed inside the tub to accommodate laundry, and a motor configured to generate a driving force for rotating the drum, the control method including: (a) in a state in which the motor is stopped, driving the motor and accelerating rotation of the motor so that a rotational speed of the motor reaches a first rotations-per-minute (RPM); (b) while a rotational direction of the motor is maintained, decelerating the rotation of the motor so that the rotational speed of the motor reaches a second RPM; (c) while the rotational direction of the motor is maintained, re-accelerating the rotation of the motor so that the rotational speed of the motor reaches a third RPM; (d) stopping the motor; (e) driving the motor so that the motor rotates in a direction opposite to the rotational direction before the motor stops and accelerating rotation of the motor so that a rotational speed of the motor reaches the first RPM; and (f) performing (b) and (c), wherein the second RPM is a value greater than 0.

The first RPM and the third RPM may be equal values.

The first RPM may be a smaller value than the third RPM, and a difference between the first RPM and the second RPM may be set differently according to a weight of the laundry.

Prior to operation (d), operations (b) and (c) may be repeatedly performed.

A first speed (X1) is, a washing RPM at which a maximum mechanical force is generated from a minimum load unit The first RPM may be set differently according to a weight of the laundry accommodated in the drum, the first RPM may be set to be in a range of 40 to 60 RPM, and a difference between the first RPM and the second RPM may be in a range of 10 to 30 RPM.

A time taken for the first RPM to reach the second RPM and a time taken for the second RPM to reach the third RPM may be equal.

Operations (a) to (f) may be performed during a washing stroke.

In addition, another aspect of the present disclosure proposes a control method of a washing machine including a drum configured to accommodate laundry and a motor configured to transmit power to the drum, the control method including: (a) in a state in which the drum is stopped, driving the motor and accelerating rotation of the drum so that a rotational speed of the drum reaches a first RPM; (b) while a rotational direction of the drum is maintained, further accelerating the rotation of the drum so that the rotational speed of the drum reaches a second RPM; (c) while the rotational direction of the drum is maintained, decelerating the rotation of the drum so that the rotational speed of the drum reaches a third RPM; (d) while the rotational direction of the drum is maintained, re-accelerating the rotation of the drum so that the rotational speed of the drum reaches a fourth RPM; (e) stopping the drum; (f) driving the motor so that the drum rotates in a direction opposite to the rotational direction before the drum stops and accelerating rotation of the drum so that a rotational speed of the drum reaches the first RPM; and (g) performing operations (b) to (d), wherein the third RPM is a value greater than 0.

A time taken for the rotational speed of the drum to reach the first RPM from the state in which the drum is stopped may be shorter than a time taken for the rotational speed of the drum to reach the second RPM from the first RPM.

An acceleration of the drum may be constant while the rotational speed of the drum reaches the first RPM from the state in which the drum is stopped, and an acceleration of the drum may not be constant while the rotational speed of the drum reaches the second RPM from the first RPM.

A difference between the first RPM and the second RPM may be set differently according to the weight of the laundry accommodated in the drum.

In addition, one aspect of the present disclosure proposes a washing machine including a tub configured to accommodate water, a drum installed inside the tub to accommodate laundry, a motor configured to generate a driving force for rotating the drum, and a controller configured to control a rotational speed of the drum, wherein the controller is programmed to perform: (a) in a state in which the drum is stopped, driving the motor and accelerating rotation of the drum so that the rotational speed of the drum reaches a first RPM; (b) while a rotational direction of the drum is maintained, decelerating the rotation of the drum so that the rotational speed of the drum reaches a second RPM that is greater than 0; (c) while the rotational direction of the drum is maintained, re-accelerating the rotation of the drum so that the rotational speed of the motor reaches a third RPM; (d) stopping the drum; (e) driving the motor so that the drum rotates in a direction opposite to the rotational direction before the drum stops and accelerating rotation of the motor so that a rotational speed of the drum reaches the first RPM; and (f) performing operations (b) to (d).

According to the proposed washing machine and control method thereof, a washing mechanical force can be maximized using a washing profile, in which the cycle and size of a washing rotations-per-minute (RPM) are variable, regardless of the amount of laundry or a change in the weight of the laundry due to moisture absorption of the laundry. In addition, the head drop behavior of the laundry can be diversified through the washing profile in which the cycle and size of the washing RPM are variable, and in this way, by allowing water (washing water) to be effectively infiltrated into the laundry, the washing performance can be improved. In addition, by continuously showing various washing operations (rubbing, tapping, centrifugal rotation, or the like), an effect of enhancing the visibility of washing can be obtained.

DETAILED DESCRIPTION

Figure 1:
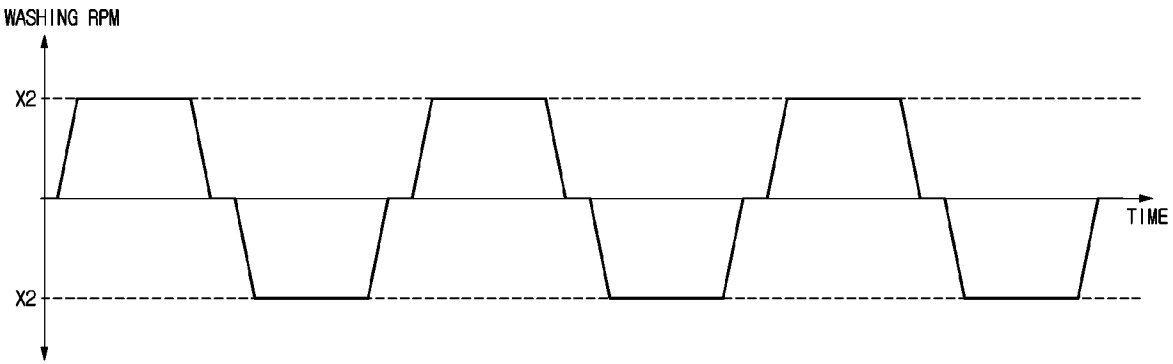
FIG. 1 is an operation waveform diagram illustrating a conventional fixed washing rotations-per-minute (RPM).
Figure 2A:
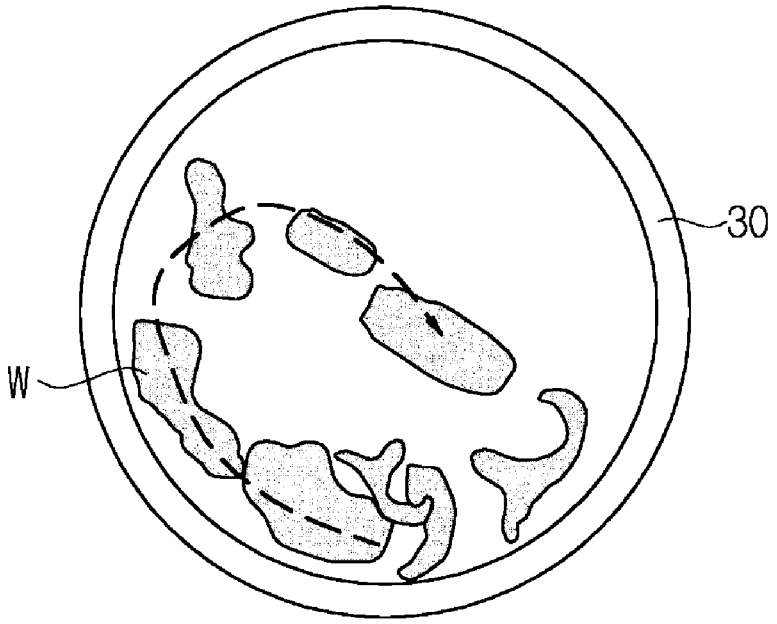
FIG. 2A is a view illustrating a head drop behavior of laundry exhibited at an initial stage of washing.
Figure 2B:
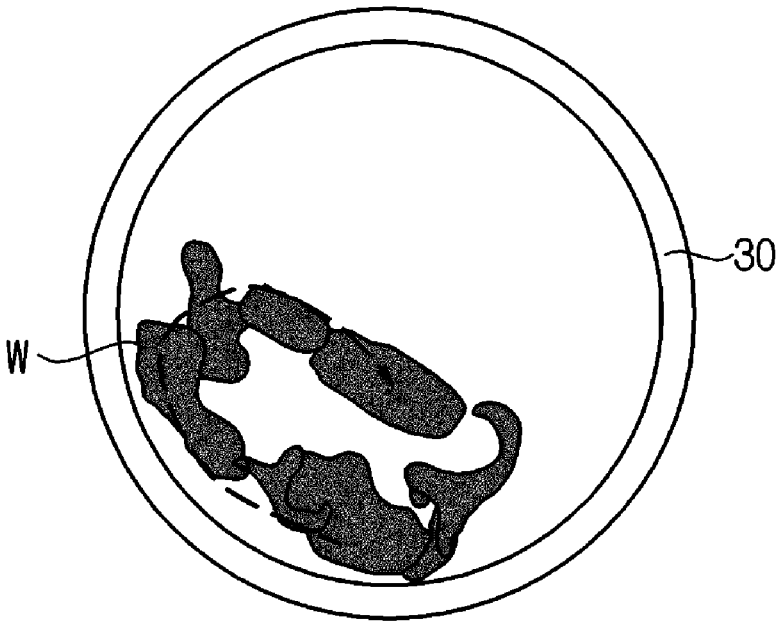
FIG. 2B is a view illustrating a head drop behavior of laundry exhibited when washing is performed using the washing RPM illustrated in FIG. 1.

Embodiments described herein and configurations illustrated in the drawings are merely exemplary examples of the present disclosure, and various modifications which may replace the embodiments and the drawings herein may be present at the time of filing this application.

Embodiments described herein and configurations illustrated in the drawings are merely exemplary examples of the present disclosure, and various modifications which may replace the embodiments and the drawings herein may be present at the time of filing this application.

Terms used herein are for describing the embodiments and are not intended to limit and/or restrict the disclosure. A singular expression includes a plural expression unless context clearly indicates otherwise. In the application, terms such as "include" or "have" should be understood as designating that features, numbers, steps, operations, elements, parts, or combinations thereof exist and not as precluding the existence of or the possibility of adding one or more other features, numbers, steps, operations, elements, parts, or combinations thereof in advance.

Terms including ordinals such as "first" and "second" used herein may be used to describe various elements, but the elements are not limited by the terms. The terms are only used for the purpose of distinguishing one element from another element. For example, a first element may be referred to as a second element while not departing from the scope of the present disclosure, and likewise, a second element may also be referred to as a first element. The term "and/or" includes a combination of a plurality of related described items or any one item among the plurality of related described items.

Hereinafter, an embodiment according to the present disclosure will be described in detail with reference to the accompanying drawings.

Figure 3:
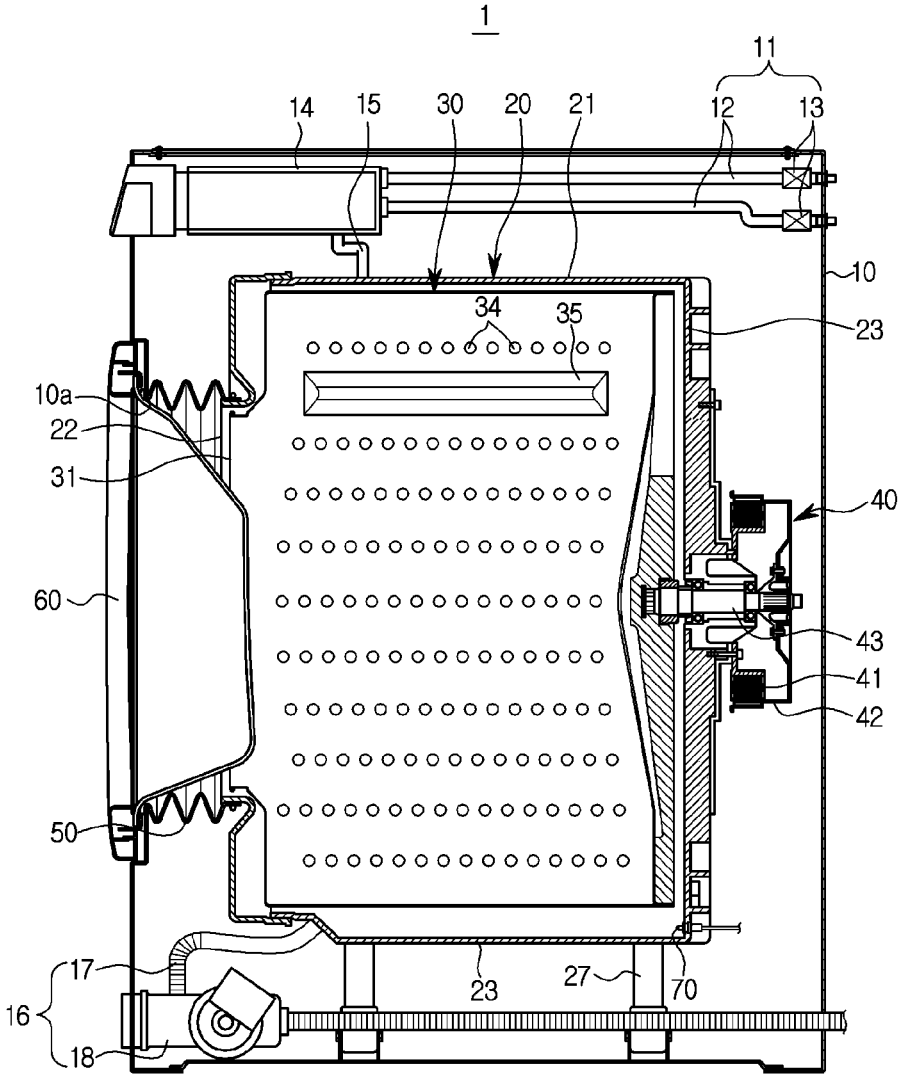
FIG. 3 is a cross-sectional view illustrating a configuration of a washing machine according to an embodiment of the present disclosure.

FIG. 3 is a view illustrating a configuration of a washing machine according to an embodiment of the present disclosure.

In FIG. 3, a washing machine 1 includes a main body 10 forming an exterior and configured to accommodate various components therein, a tub 20 configured to accommodate water (washing water or rinsing water) to be used in a washing stroke or rinsing stroke, a drum 30 configured to accommodate and rotate laundry, and a motor 40 configured to rotate the drum 30.

The main body 10 has a substantially box-like shape and is formed of a front plate, a rear plate, an upper plate, a bottom plate, and a side plate. An inlet 10*a* is formed in the front plate to allow laundry to be put inside the drum 30.

The inlet 10*a* of the main body 10 may be opened and closed by a door 60 installed at a front surface of the main body 10. The door 60 may be rotatably coupled to the main body 10 by a hinge member. The door 60 may be formed of a glass member and a door frame configured to support the glass member.

The glass member may be formed of a transparent tempered glass material so that the inside of the main body 10 is seen through. Also, the glass member may be provided to protrude toward the inside of the tub 20 so that the laundry is prevented from leaning toward the door 60.

The tub 20 is formed in a substantially cylindrical shape and is installed inside the main body 10. The tub 20 may be supported by a suspension device 27. The tub 20 may include a hollow cylindrical portion 21, an opening 22 formed at one side of the cylindrical portion 21 so as to correspond to the inlet 10*a*, and a bottom portion 23 formed at the other side of the cylindrical portion 21.

The inlet 10*a* of the front plate of the main body and the opening 22 of the tub 20 may be connected by a diaphragm 50. The diaphragm 50 may form a path connecting the inlet 10*a* of the front plate of the main body and the opening 22 of the tub 20 to guide the laundry, which is inserted through the inlet 10*a*, to the inside of the drum 30 and reduce transmission of vibration, which occurs during rotation of the drum 30, to the front plate of the main body 10.

The drum 30 has a substantially cylindrical shape with an open front surface and is installed inside the tub 20. A central axis of the drum 30 may be disposed parallel to a central axis of the tub 20.

The drum 30 may rotate inside the tub 20. The drum 30 may lift and drop the laundry by rotating so that washing is performed. To this end, a lifter 35 configured to lift the laundry when the drum 30 rotates may be provided at an inner circumferential surface of the drum 30. A plurality of through-holes 34 may be formed along a circumference of the drum 30 so that washing water stored in the tub 20 is circulated.

A water supply device 11 for supplying water to the inside of the tub 20 is installed at an upper portion of the tub 20. The water supply device 11 is formed of a water supply pipe 12 through which water is supplied from an external water supply source and a water supply valve 13 configured to open and close the water supply pipe 12.

A detergent supply device 14 configured to supply a detergent to the tub 20 is installed at a front upper portion of the main body 10. The detergent supply device 14 may be connected to the tub 20 through a connecting pipe 15. The water supplied through the water supply pipe 12 may be supplied to the inside of the tub 20 together with the detergent via the detergent supply device 14.

The motor 40 configured to generate a rotational force for rotating the drum 30 is installed at a rear portion of the tub 20. The motor 40 may be formed of a fixed stator 41 and a rotor 42 configured to rotate by electromagnetically interacting with the stator 41 and may convert an electric force to a mechanical rotational force.

The rotational force generated in the motor 40 may be transmitted to the drum 30 through a driving shaft 43. The driving shaft 43 may be provided to be press-fitted in the rotor 42 of the motor 40 and rotate together with the rotor 42 and may connect the drum 30 and the motor 40 by passing through a rear wall of the tub 20.

The washing machine 1 includes a drain device 16 capable of draining water from the tub 20. The drain device 16 may be formed of a drain pipe 17 connected to a lower portion of the tub 20 to guide water to the outside of the main body 10 and a drain pump 18 connected to the drain pipe 17 to pump water from the tub 20. In an embodiment of the present disclosure, the case in which the drain pump 18 is installed for discharge of water has been described as an example, but the present disclosure is not limited thereto, and a drain motor or a drain valve may be installed.

In addition, a water level sensor 70 configured to detect a water level frequency that changes according to a water level may be installed at a lower inner portion of the tub 20 in order to detect the amount of water (water level) in the tub 20.

Figure 4:
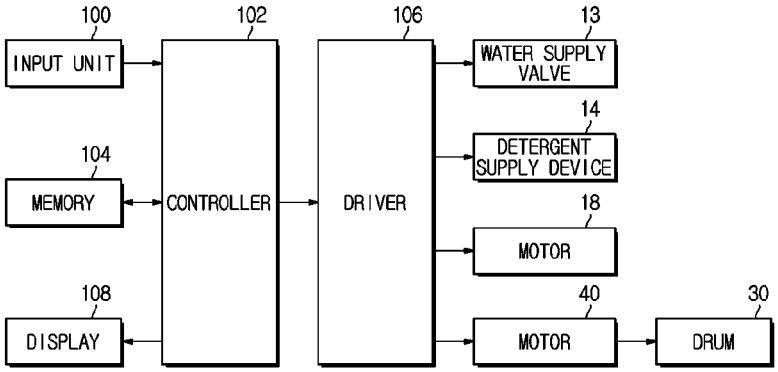
FIG. 4 is a control block diagram of a washing machine according to an embodiment of the present disclosure.

FIG. 4 is a control block diagram of a washing machine according to an embodiment of the present disclosure.

In FIG. 4, a washing machine 1 according to an embodiment of the present disclosure includes an input unit 100, a controller 102, a memory 104, a driver 106, and a display 108.

The input unit 100 is for inputting a command for performing a washing stroke, a rinsing stroke, a spin-drying stroke, and the like of the washing machine 1 by a user's manipulation. The input unit 100 may be formed of a key, a button, a switch, a touch pad, or the like and includes any device that generates predetermined input data due to a manipulation such as pressing, touching, exerting pressure, rotating, and the like.

In addition, the input unit 100 may include a plurality of buttons (power, reservation, temperature of washing water, soak, wash, rinse, spin-dry, select water level, etc.) through which a user command related to an operation of the washing machine 1 is input. Among the plurality of buttons, a course selection button for selecting a washing course (a plurality of washing courses include a standard course, a wool course, a boiling course, a drying course, and the like) according to a type of laundry put in the washing machine 1 may be provided.

The controller 102 may include one or more processors configured to control the overall operation of the washing machine 1 such as a washing stroke, a rinsing stroke, and a spin-drying stroke according to operation information input from the input unit 100.

The controller 102 may set, in a selected washing course, an amount of washing water (target washing water level) and an amount of rinsing water (target rinsing water level), a target rotations-per-minute (RPM) and a motor operation rate (on-off time of washing motor), washing time, the number of rinsing, and the like according to a weight (load amount) of laundry.

Also, the controller 102 provides a washing profile in which the cycle and size of a washing RPM are variable so that a washing mechanical force may be maximized regardless of a change in the amount or weight of laundry during an operation of the washing machine 1 (specifically, while the washing stroke is performed). This will be described below with reference to FIGS. 5 to 7.

In addition, after insertion of the laundry, the controller 102 may detect the weight of the laundry according to driving of the motor 40 before the washing stroke is performed. As an example of a method of detecting the weight of the laundry, the motor 40 is driven to accelerate the drum 30, in which the laundry is stored, to a predetermined speed, and then predetermined torque (or a predetermined voltage) is applied to the drum 30, and an acceleration time taken for the drum 30 to reach the predetermined speed is used to detect the weight of the laundry. Because the acceleration time here is proportional to the weight of the laundry, the weight of the laundry may be estimated using a reference table of the weight corresponding to the acceleration time.

The memory 104 may store control data for controlling operation of the washing machine 1, reference data used in operation control of the washing machine 1, operation data generated while the washing machine 1 performs a predetermined operation, set information such as set data input by input units 81*a* and 81*b* so that the washing machine 1 performs a predetermined operation, the number of times the washing machine 1 has performed a certain operation, use information including model information of the washing machine, and failure information including reasons for malfunctioning or a malfunction site when malfunction of the washing machine 1 occurs.

Also, the memory 104 may be implemented using a nonvolatile memory device such as a read only memory (ROM), a programmable ROM (PROM), an erasable PROM (EPROM), and a flash memory, a volatile memory device such as a random access memory (RAM), or a storage device such as a hard disk and an optical disk. However, the memory 104 is not limited thereto, and various other storage devices that may be taken into consideration by a designer may be used.

The driver 106 drives the water supply valve 13, the detergent supply device 14, the drain pump 18, the motor 40, and the like related to the operation of the washing machine 1 according to a driving control signal of the controller 102.

The display 108 displays an operational state of the washing machine 1 according to a display control signal of the controller 102 and displays a user manipulation state by recognizing operation information input through the input unit 100. A liquid crystal display (LCD) panel, a light emitting diode (LED) panel, or the like may be employed as the display 108.

Figure 5:
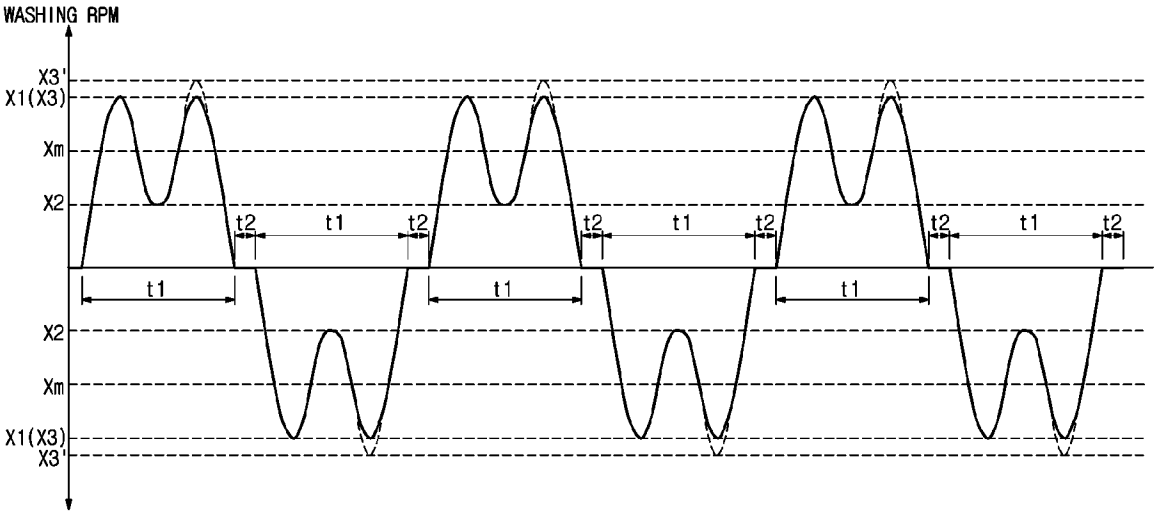
FIG. 5 is an operation waveform diagram illustrating a variable washing RPM applied to a washing machine according to an embodiment of the present disclosure.

FIG. 5 is an operation waveform diagram illustrating a variable washing RPM applied to a washing machine according to an embodiment of the present disclosure.

In FIG. 5, in a state in which the motor 40 is stopped, the controller 102 drives the motor 40 to accelerate rotation of the motor 40 so that a rotational speed of the motor 40 reaches a first RPM X1 (an RPM at which the maximum mechanical force is generated from a maximum load unit, about 55 RPM), and while a rotational direction of the motor 40 is maintained, the controller 102 decelerates the rotation of the motor 40 so that the rotational speed of the motor 40 reaches a second RPM X2 (an RPM, which is greater than 0, at which the maximum mechanical force is generated from a minimum load unit, about 40 RPM). Then, while the rotational direction of the motor 40 is kept unchanged, the controller 102 re-accelerates the rotation of the motor 40 so that the rotational speed of the motor 40 reaches a third RPM X3 (an RPM higher than or equal to X1, 55 RPM or higher) and then stops the motor 40.

Next, the controller 102 drives the motor 40 in a direction opposite to the rotational direction before the motor 40 stops and accelerates rotation of the motor 40 so that a rotational speed of the motor 40 reaches the first RPM X1, and while the rotational direction of the motor 40 is maintained, the controller 102 decelerates the rotation of the motor 40 so that the rotational speed of the motor 40 reaches the second RPM X2. Then, while the rotational direction of the motor 40 is kept unchanged, the controller 102 re-accelerates the rotation of the motor 40 so that the rotational speed of the motor 40 reaches the third RPM X3 and then stops the motor 40.

In this way, the controller 102 performs washing by changing the washing RPM from the second RPM X2 to the first RPM X1 or third RPM X3. The washing RPM, which is changed from the second RPM X2 to the first RPM X1 or third RPM X3, may be applied during each washing regardless of a change in the amount and weight of laundry. In this case, by setting the third RPM X3 to an RPM X3' which is higher than the first RPM X1 and changing the washing RPM, the flow of the laundry may be changed.

A medium speed Xm between the second RPM X2 and the first RPM X1 is a washing RPM at which the optimal mechanical force is generated in an existing washing stroke. A value around about 45 to 50 RPM may be used as the medium speed Xm.

That is, the controller 102 changes the washing RPM from the second RPM X2 to the first RPM X1 or third RPM X3 to rotate the drum 30 in forward and reverse directions, and according to the change in the washing RPM, the head drop behavior of laundry W occurs in various directions.

In this case, the controller 102 controls the variable form of the washing RPM, which changes from the second RPM X2 to the first RPM X1 or third RPM X3, to be in the form of a sine wave so that the flow of the laundry is maximized.

Also, the variable range of the washing RPM, which is changed from the second RPM X2 to the first RPM X1 or third RPM X3, may be set differently according to a weight (cloth weight) of laundry. That is, by adjusting the variable range of the washing RPM, which is changed from the second RPM X2 to the first RPM X1 or third RPM X3, according to the weight of laundry with respect to the medium speed Xm, an optimal head drop behavior, which is suitable for the weight of laundry, may be implemented in various ways.

For example, when the weight of laundry is the minimum load (single load), the variable range of the washing RPM, which is changed from the second RPM X2 to the first RPM X1 or third RPM X3, may be adjusted to be 40 to 50 RPM to control the head drop behavior of the laundry W to be suitable for the minimum load.

Also, when the weight of the laundry is a medium load, the variable range of the washing RPM, which is changed from the second RPM X2 to the first RPM X1 or third RPM X3, may be adjusted to be 45 to 55 RPM to control the head drop behavior of the laundry W to be suitable for the medium load.

In addition, when the weight of the laundry is the maximum load (the indicated capacity load), the variable range of the washing RPM, which is changed from the second RPM X2 to the first RPM X1 or third RPM X3, may be adjusted to be 45 to 60 RPM to control the head drop behavior of the laundry W to be suitable for the maximum load.

Meanwhile, although FIG. 5 illustrates that two sine wave cycles of the washing RPM, which is changed from the second RPM X2 to the first RPM X1 or third RPM X3 to rotate the drum 30 in the forward or reverse direction, are exhibited in each section, this is merely for helping understanding of the disclosure. In reality, of course, the cycle of the washing RPM controlled in the form of a sine wave may vary according to a change in the amount or weight of laundry, and two or more sine wave cycles may also be exhibited in each section.

Figure 6:
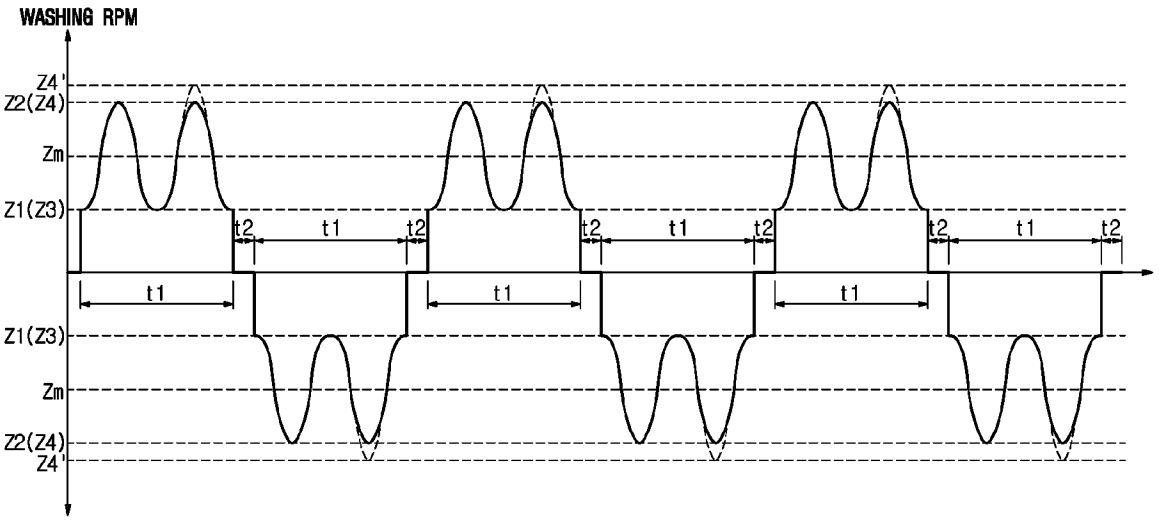
FIG. 6 is another operation waveform diagram of FIG. 5.

FIG. 6 is another operation waveform diagram of FIG. 5.

In FIG. 6, in a state in which the drum 30 is stopped, the controller 102 drives the motor 40 to accelerate rotation of the drum 30 so that a rotational speed of the drum 30 reaches a first RPM Z1 (an RPM at which the maximum mechanical force is generated from a minimum load unit, about 40 RPM). While a rotational direction of the drum 30 is maintained, the controller 102 further accelerates the rotation of the drum 30 so that the rotational speed of the drum 30 reaches a second RPM Z2 (an RPM at which the maximum mechanical force generated from a maximum load unit, about 55 RPM), and while the rotational direction of the drum 30 is kept unchanged, the controller 102 decelerates the rotation of the drum 30 so that the rotational speed of the drum 30 reaches a third RPM Z3 (an RPM higher than or equal to Z1). Then, while the rotational direction of the drum 30 is kept unchanged, the controller 102 re-accelerates the rotation of the drum 30 so that the rotational speed of the drum 30 reaches a fourth RPM Z4 (an RPM higher than or equal to Z2, 55 RPM or higher) and then stops the drum 30.

Next, the controller 102 drives the motor 40 in a direction opposite to the rotational direction before the drum 30 stops and accelerates rotation of the drum 30 so that a rotational speed of the drum 30 reaches the first RPM Z1. While the rotational direction of the drum 30 is maintained, the controller 102 further accelerates the rotation of the drum 30 so that the rotational speed of the drum 30 reaches the second RPM Z2, and while the rotational direction of the drum 30 is kept unchanged, the controller 102 decelerates the rotation of the drum 30 so that the rotational speed of the drum 30 reaches the third RPM Z3. Then, while the rotational direction of the drum 30 is kept unchanged, the controller 102 re-accelerates the rotation of the drum 30 so that the rotational speed of the drum 30 reaches the fourth RPM Z4 and then stops the drum 30.

Also, a time taken for the rotational speed of the drum 30 to reach the first RPM from the state in which the drum 30 is stopped is shorter than a time taken for the rotational speed of the drum 30 to reach the second RPM from the first RPM.

In addition, an acceleration of the drum 30 is constant while the rotational speed of the drum 30 reaches the first RPM from the state in which the drum 30 is stopped, and the acceleration of the drum 30 is variable, instead of being constant, while the rotational speed of the drum 30 reaches the second RPM from the first RPM.

In this way, the controller 102 performs washing by changing the washing RPM from the first RPM Z1 or third RPM Z3 to the second RPM Z2 or fourth RPM Z4. The washing RPM, which is changed from the first RPM Z1 or third RPM Z3 to the second RPM Z2 or fourth RPM Z4, may be applied during each washing regardless of a change in the amount and weight of laundry. In this case, by setting the fourth RPM Z4 to an RPM Z4' which is higher than the second RPM Z2 and changing the washing RPM, the flow of the laundry may be changed.

A medium speed Zm between the first RPM Z1 and the second RPM Z2 is a washing RPM at which the optimal mechanical force is generated in an existing washing stroke. A value around about 45 to 50 RPM may be used as the medium speed Zm.

That is, the controller 102 changes the washing RPM from the first RPM Z1 or third RPM Z3 to the second RPM Z2 or fourth RPM Z4 to rotate the drum 30 in the forward and reverse directions, and according to the change in the washing RPM, the head drop behavior of laundry W occurs in various directions.

In this case, the controller 102 controls the variable form of the washing RPM, which changes from the first RPM Z1 or third RPM Z3 to the second RPM Z2 or fourth RPM Z4, to be in the form of a sine wave so that the flow of the laundry is maximized.

Also, the variable range of the washing RPM, which is changed from the first RPM Z or third RPM Z3 to the second RPM Z2 or fourth RPM Z4, may be set differently according to a weight (cloth weight) of laundry. That is, by adjusting the variable range of the washing RPM, which is changed from the first RPM Z1 or third RPM Z3 to the second RPM Z2 or fourth RPM Z4, according to the weight of laundry with respect to the medium speed Zm, an optimal head drop behavior, which is suitable for the weight of laundry, may be implemented in various ways.

For example, when the weight of laundry is the minimum load (single load), the variable range of the washing RPM, which is changed from the first RPM Z1 or third RPM Z3 to the second RPM Z2 or fourth RPM Z4, may be adjusted to be 40 to 50 RPM to control the head drop behavior of the laundry W to be suitable for the minimum load.

Also, when the weight of the laundry is a medium load, the variable range of the washing RPM, which is changed from the first RPM Z1 or third RPM Z3 to the second RPM Z2 or fourth RPM Z4, may be adjusted to be 45 to 55 RPM to control the head drop behavior of the laundry W to be suitable for the medium load.

In addition, when the weight of the laundry is the maximum load (the indicated capacity load), the variable range of the washing RPM, which is changed from the first RPM Z1 or third RPM Z3 to the second RPM Z2 or fourth RPM Z4, may be adjusted to be 45 to 60 RPM to control the head drop behavior of the laundry W to be suitable for the maximum load.

Meanwhile, although FIG. 6 illustrates that two sine wave cycles of the washing RPM, which is changed from the first RPM Z1 or third RPM Z3 to the second RPM Z2 or fourth RPM Z4 to rotate the drum 30 in the forward or reverse direction, are exhibited in each section, this is merely for helping understanding of the disclosure. In reality, of course, the cycle of the washing RPM controlled in the form of a sine wave may vary according to a change in the amount or weight of laundry, and two or more sine wave cycles may also be exhibited in each section.

Figure 7:
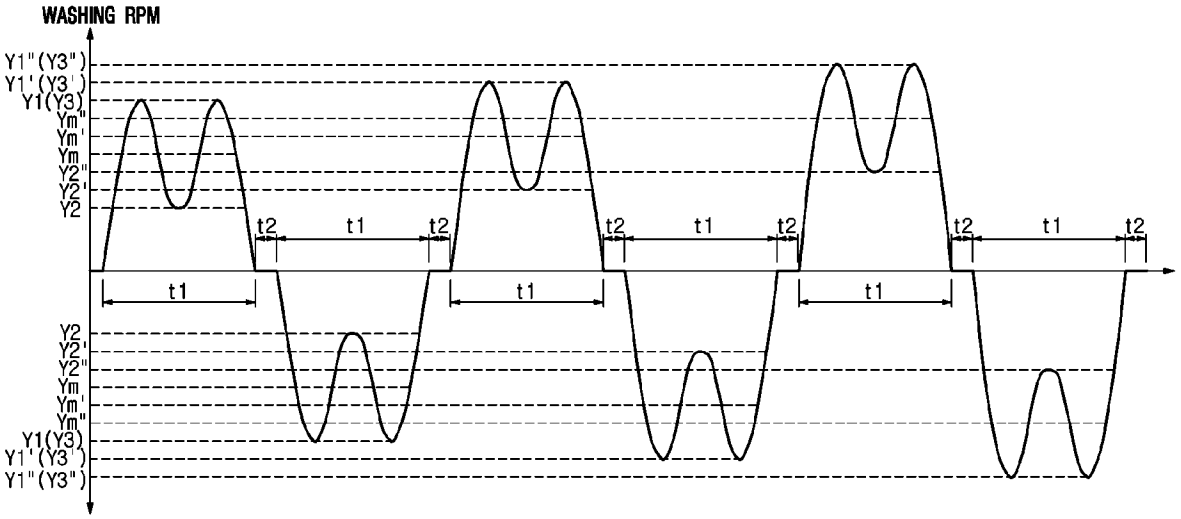
FIG. 7 is an operation waveform diagram illustrating a variable washing RPM applied to a washing machine according to another embodiment of the present disclosure.

FIG. 7 is an operation waveform diagram illustrating a variable washing RPM applied to a washing machine according to another embodiment of the present disclosure.

In FIG. 7, the controller 102 performs washing by changing the washing RPM from a second RPM Y2 (an RPM at which the maximum mechanical force is generated from a minimum load unit, about 40 RPM) to a first RPM Y1 or a third RPM Y3 (an RPM at which the maximum mechanical force is generated from a maximum load unit, about 55 RPM). In this case, the controller 102 may change the speed of the washing RPM by gradually increasing the sizes of the second RPM Y2 and the first RPM Y1 or third RPM Y3 to the second RPM (Y2→Y2'→Y2") and the first RPM (Y1→Y1'→Y1") or third RPM (Y3→Y3'→Y3").

The washing RPM, which is changed from the second RPM (Y2→Y2'→Y2") to the first RPM (Y1→Y1'→Y1") or third RPM (Y3→Y3'→Y3"), may be applied during each washing regardless of a change in the amount and weight of laundry.

Medium speeds Ym, Ym', and Ym between the second RPMs (Y2→Y2'→Y2") and the first RPMs (Y1→Y1'→Y1") are washing RPMs at which the optimal mechanical force is generated in an existing washing stroke. A value around about 47 RPM may be used as the medium speeds Ym, Ym', and Ym".

That is, by repeatedly performing an operation of changing the washing RPM from the second RPM Y2 to the first RPM Y1 or third RPM Y3 to rotate the drum 30 in the forward and reverse directions, changing the washing RPM from the second RPM Y2' to the first RPM Y1' or third RPM Y3' to rotate the drum 30 in the forward and reverse directions, and then changing the washing RPM from the second RPM Y2" to the first RPM Y1" or third RPM Y3" to rotate the drum 30 in the forward and reverse directions, the controller 102 may control the head drop behavior of laundry W to occur in various directions.

In this case, the controller 102 controls the variable forms of all of the washing RPM from the second RPM Y2 to the first RPM Y1 or third RPM Y3, the washing RPM from the second RPM Y2' to the first RPM Y1' or third RPM Y3', and the washing RPM from the second RPM Y2" to the first RPM Y1" or third RPM Y3" to be in the form of a sine wave so that the flow of the laundry is maximized.

Meanwhile, although FIG. 7 illustrates that the size of a sine wave of the washing RPM, which is changed from the second RPM (Y2→Y2'→Y2") to the first RPM (Y1→Y1'→Y1") or third RPM (Y3→Y3'→Y3") to rotate the drum 30 in the forward or reverse direction, increases in three stages, this is merely for helping understanding of the disclosure. In reality, of course, the size of the washing RPM controlled in the form of a sine wave may vary according to a change in the amount or weight of laundry, and the size of the sine wave of the washing RPM may also be implemented to increase in three stages or more.

Hereinafter, an operational process and effects of a washing machine and control method thereof according to an embodiment of the present disclosure will be described.

Figure 8A:
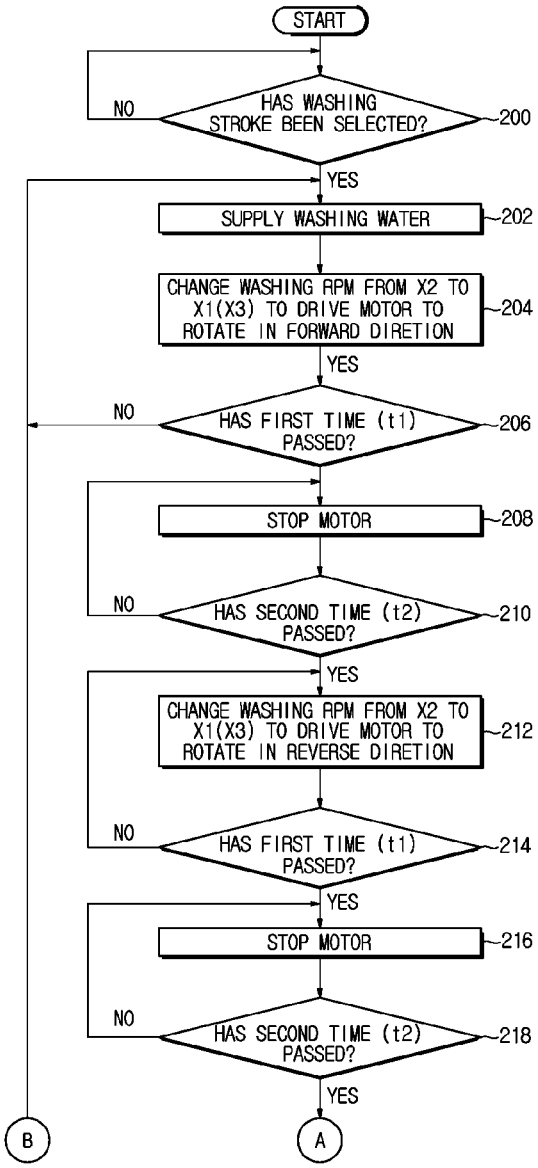
FIGS. 8A and 8B are operation flowcharts illustrating a first control algorithm in which washing is performed using the washing RPM illustrated in FIG. 5.
Figure 8B:
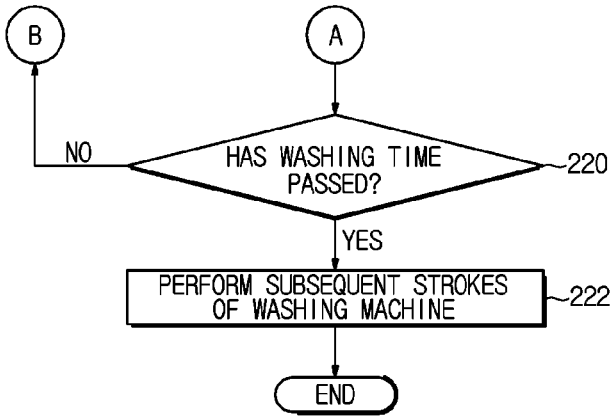

FIGS. 8A and 8B are operation flowcharts illustrating a first control algorithm in which washing is performed using the washing RPM illustrated in FIG. 5, and FIGS. 10A to 10C are views illustrating the head drop behavior of laundry exhibited when washing is performed using the washing RPM illustrated in FIG. 5.

In FIGS. 8A and 8B, a user opens the door 60, puts laundry inside the drum 30 through the inlet 10*a*, closes the door 60, and then selects a washing course (a plurality of washing courses include a standard course, a wool course, a delicate course, a boiling course, and the like) and a stroke. In this case, operation information selected by the user is input to the controller 102 through the input unit 100.

According to the operation information input from the input unit 100, the controller 102 performs washing by a series of operations such as a washing stroke in which dirt on laundry is separated using water (specifically, washing water) in which a detergent is dissolved, a rinsing stroke in which bubbles or residual detergent on the laundry are rinsed using water (specifically, rinsing water) not containing the detergent, and a spin-drying stroke in which the laundry is spin-dried at a high speed.

An embodiment of the present disclosure provides a washing profile capable of maximizing a washing mechanical force regardless of the amount and weight of laundry. This will be described using the washing stroke as an example.

Thus, the controller 102 determines whether the washing stroke has been selected (200), and when the washing stroke has been selected, the controller 102 operates the water supply valve 13 and the detergent supply device 14 by using the driver 106 so as to supply water (washing water) necessary for the washing stroke.

When the water supply valve 13 is operated, as the water supply valve 13 is opened, water (washing water) supplied from the external water supply source passes through the water supply pipe 12 and the detergent supply device 14 and is supplied into the tub 20 together with a detergent (202).

Accordingly, the controller 102 detects a water level of the water supplied to the tub 20 by using the water level sensor 70, determines whether the water level is a set target water level (a water level set according to the amount of washing water), and continues the water supply operation until the water level of the water supplied to the tub 20 reaches the target water level.

When the supply of washing water up to the target water level is completed, the controller 102 changes the washing RPM of the motor 40 from the second RPM X2 to the first RPM X1 or third RPM X3 as illustrated in FIG. 5 and drives the motor 40 to rotate in the forward direction by using the driver 106. According to the forward rotation drive of the motor 40, the drum 30 is rotated in the forward direction (204).

In this case, the controller 102 counts time during which the motor 40 is driven to rotate in the forward direction at the washing RPM changed from the second RPM X2 to the first RPM X1 or third RPM X3 and determines whether a predetermined first time t1 (a motor-on time set according to an operation rate, about 27 seconds) has passed (206).

When, as a result of the determination in operation 206, the first time t1 has not passed, the controller 102 returns to operation 204 and changes the washing RPM from the second RPM X2 to the first RPM X1 or third RPM X3 to drive the motor 40 to rotate in the forward direction until the first time t1 passes.

Meanwhile, when, as a result of the determination in operation 206, the first time t1 has passed, the controller 102 stops the motor 40 by using the driver 106 (208) and counts time during which the motor 40 is stopped and determines whether a predetermined second time t2 (a motor-off time according to an operation rate, about 3 seconds) has passed (210).

When, as a result of the determination in operation 210, the second time t2 has not passed, the controller 102 returns to operation 208 and performs subsequent operations.

Meanwhile, when, as a result of the determination in operation 210, the second time t2 has passed, the controller 102 changes the washing RPM of the motor 40 from the second RPM X2 to the first RPM X1 or third RPM X3 as illustrated in FIG. 5 and drives the motor 40 to rotate in the reverse direction by using the driver 106. According to the reverse rotation drive of the motor 40, the drum 30 is rotated in the reverse direction (212).

In this case, the controller 102 counts time during which the motor 40 is driven to rotate in the reverse direction at the washing RPM changed from the second RPM X2 to the first RPM X1 or third RPM X3 and determines whether the predetermined first time t1 has passed (214).

When, as a result of the determination in operation 214, the first time t1 has not passed, the controller 102 returns to operation 212 and changes the washing RPM from the second RPM X2 to the first RPM X1 or third RPM X3 to drive the motor 40 to rotate in the reverse direction until the first time t1 passes.

Meanwhile, when, as a result of the determination in operation 214, the first time t1 has passed, the controller 102 stops the motor 40 by using the driver 106 (216) and counts time during which the motor 40 is stopped and determines whether the predetermined second time t2 has passed (218).

When, as a result of the determination in operation 218, the second time t2 has not passed, the controller 102 returns to operation 216 and performs subsequent operations.

Figure 10A:
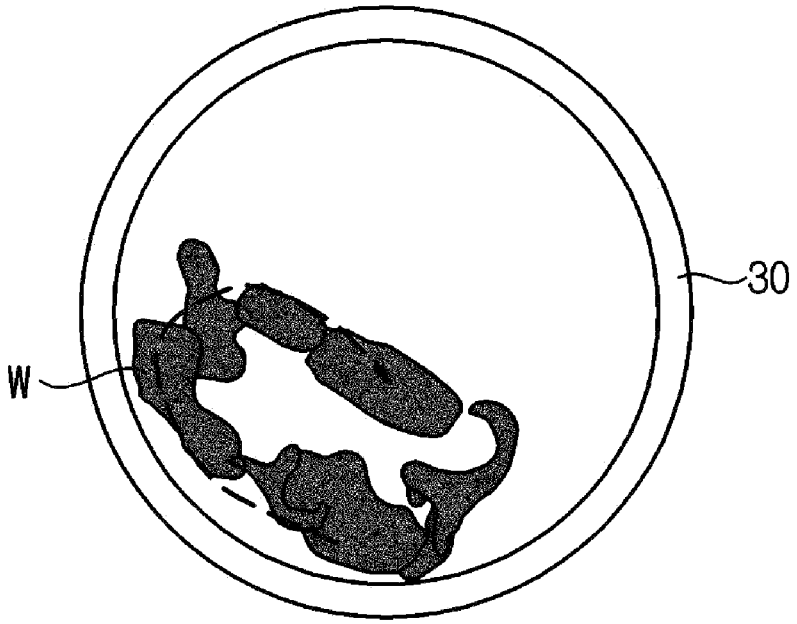
FIGS. 10A to 10C are views illustrating a head drop behavior of laundry exhibited when washing is performed using the washing RPMs illustrated in FIGS. 5 and 7.
Figure 10B:
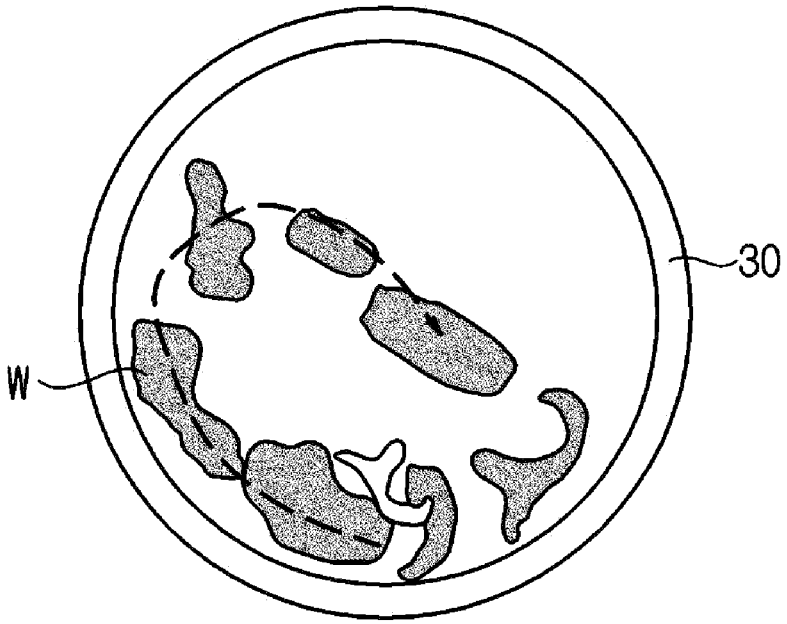
Figure 10C:
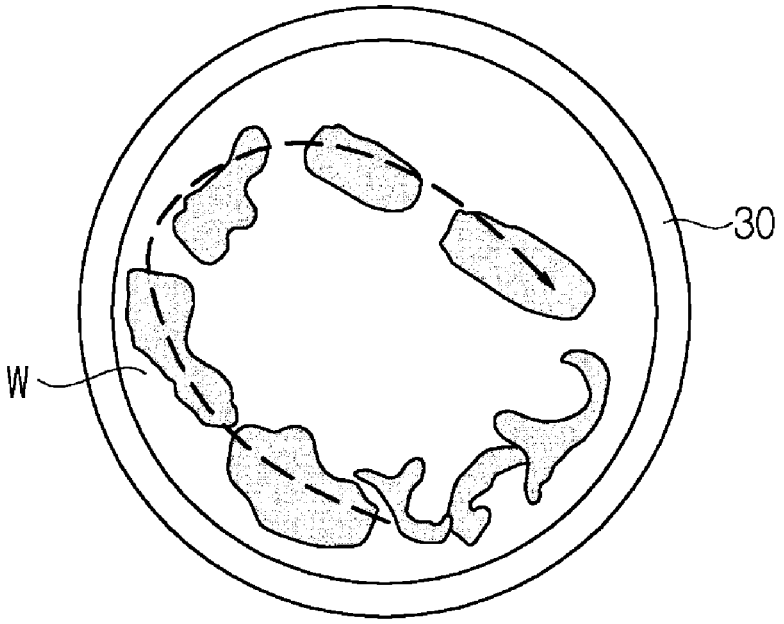

In this way, when the washing RPM of the motor 40 is changed from the second RPM X2 to the first RPM X1 or third RPM X3 to rotate the drum 30 in the forward and reverse directions, according to the change in the washing RPM, the head drop behavior of laundry W occurs in various directions as illustrated in FIGS. 10A to 10C.

Thus, because of the head drop behavior of the laundry W which occurs in various directions according to the change in the washing RPM, water (washing water) can be effectively infiltrated into the laundry W, and by continuously showing various washing operations (rubbing, tapping, centrifugal rotation, or the like), an effect of enhancing the visibility of washing can be felt by the user.

Meanwhile, when, as a result of the determination in operation 218, the second time t2 has passed, the controller 102 determines whether a washing time has passed (220).

When, as a result of the determination in operation 220, the washing time has not passed, the controller 102 returns to operation 204 and repeats the operation of changing the washing RPM of the motor 40 from the second RPM X2 to the first RPM X1 or third RPM X3 to rotate the drum 30 in the forward and reverse directions until the washing time passes.

Meanwhile, when, as a result of the determination in operation 220, the washing time has passed, the controller 102 ends the washing stroke and proceeds to subsequent strokes of the washing machine 1 (specifically, the rinsing stroke and spin-drying stroke) (222).

Figure 9A:
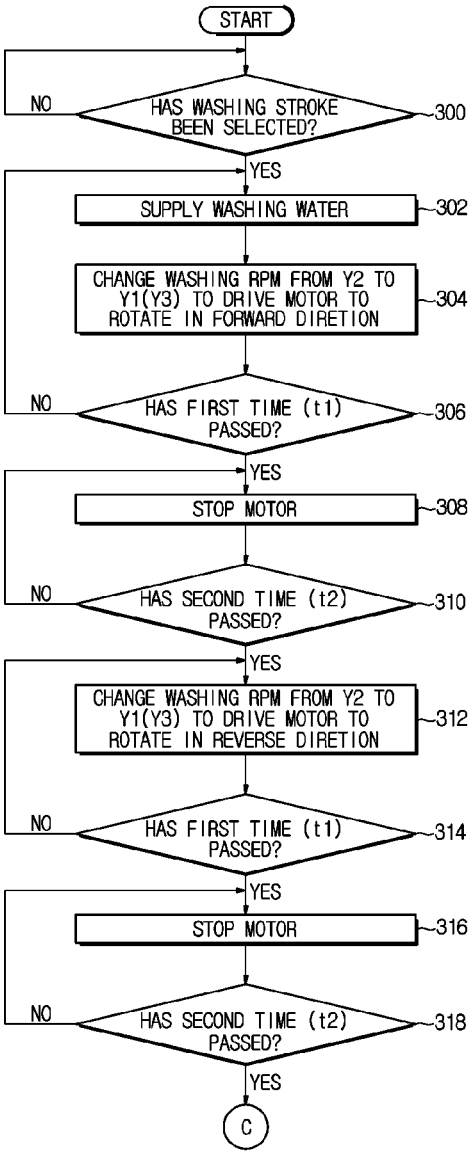
FIGS. 9A to 9C are operation flowcharts illustrating a second control algorithm in which washing is performed using the washing RPM illustrated in FIG. 7.
Figure 9B:
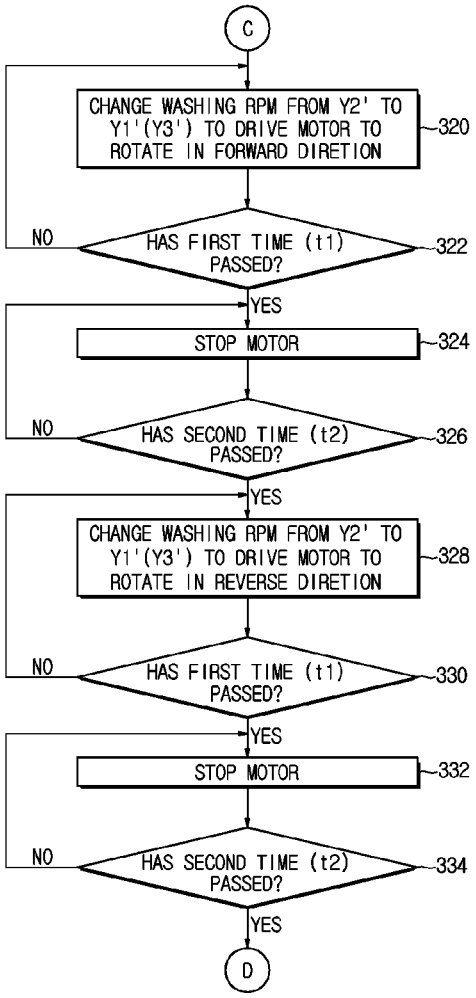
Figure 9C:
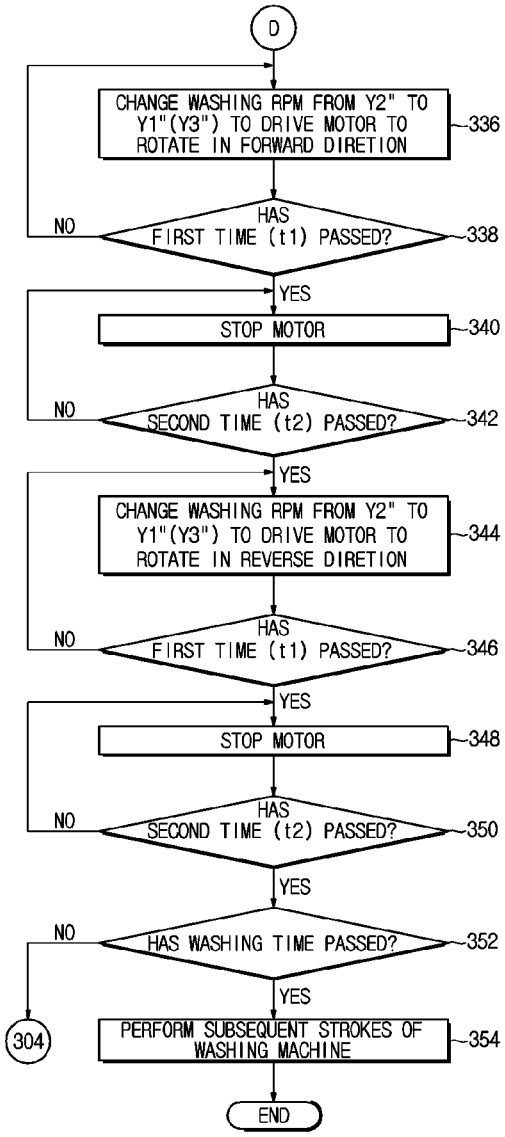

FIGS. 9A to 9C are operation flowcharts illustrating a second control algorithm in which washing is performed using the washing RPM illustrated in FIG. 7. Description overlapping that given above with reference to FIGS. 8A and 8B will be omitted as much as possible.

In FIGS. 9A to 9C, the user puts laundry inside the drum 30 and then selects a washing course (a plurality of washing courses include a standard course, a wool course, a delicate course, a boiling course, and the like) and a stroke. The operation information selected by the user is input to the controller 102 through the input unit 100.

Thus, the controller 102 determines whether the washing stroke has been selected (300), and when the washing stroke has been selected, the controller 102 operates the water supply valve 13 and the detergent supply device 14 by using the driver 106.

When the water supply valve 13 is operated, water (washing water) supplied from the external water supply source passes through the water supply pipe 12 and the detergent supply device 14 and is supplied into the tub 20 together with a detergent (302).

When the supply of washing water up to the target water level is completed, the controller 102 changes the washing RPM of the motor 40 from the second RPM Y2 to the first RPM Y1 or third RPM Y3 as illustrated in FIG. 7 and drives the motor 40 to rotate in the forward direction by using the driver 106. According to the forward rotation drive of the motor 40, the drum 30 is rotated in the forward direction (304).

In this case, the controller 102 counts time during which the motor 40 is driven to rotate in the forward direction at the washing RPM changed from the second RPM Y2 to the first RPM Y1 or third RPM Y3 and determines whether the predetermined first time t1 has passed (306).

When, as a result of the determination in operation 306, the first time t1 has not passed, the controller 102 returns to operation 304 and changes the washing RPM from the second RPM Y2 to the first RPM Y1 or third RPM Y3 to drive the motor 40 to rotate in the forward direction until the first time t1 passes.

Meanwhile, when, as a result of the determination in operation 306, the first time t1 has passed, the controller 102 stops the motor 40 by using the driver 106 (308) and counts time during which the motor 40 is stopped and determines whether the predetermined second time t2 has passed (310).

When, as a result of the determination in operation 310, the second time t2 has not passed, the controller 102 returns to operation 308 and performs subsequent operations.

Meanwhile, when, as a result of the determination in operation 310, the second time t2 has passed, the controller 102 changes the washing RPM of the motor 40 from the second RPM Y2 to the first RPM Y1 or third RPM Y3 as illustrated in FIG. 7 and drives the motor 40 to rotate in the reverse direction by using the driver 106. According to the reverse rotation drive of the motor 40, the drum 30 is rotated in the reverse direction (312).

In this case, the controller 102 counts time during which the motor 40 is driven to rotate in the reverse direction at the washing RPM changed from the second RPM Y2 to the first RPM Y1 or third RPM Y3 and determines whether the predetermined first time t1 has passed (314).

When, as a result of the determination in operation 314, the first time t1 has not passed, the controller 102 returns to operation 312 and changes the washing RPM from the second RPM Y2 to the first RPM Y1 or third RPM Y3 to drive the motor 40 to rotate in the reverse direction until the first time t1 passes.

Meanwhile, when, as a result of the determination in operation 314, the first time t1 has passed, the controller 102 stops the motor 40 by using the driver 106 (316) and counts time during which the motor 40 is stopped and determines whether the predetermined second time t2 has passed (318).

When, as a result of the determination in operation 318, the second time t2 has not passed, the controller 102 returns to operation 316 and performs subsequent operations.

Meanwhile, when, as a result of the determination in operation 318, the second time t2 has passed, the controller 102 changes the washing RPM of the motor 40 from a second RPM Y2' (a value greater than Y2, about 43 RPM) to a first RPM Y1' (a value greater than Y1, about 58 RPM) or a third RPM Y3' (a value greater than Y3, about 58 RPM) as illustrated in FIG. 7 to drive the motor 40 to rotate in the forward direction by using the driver 106 (320). In this case, the variable range from the second RPM Y2' to the first RPM Y1' or third RPM Y3' may be set to about 43 RPM to 58 RPM.

In this case, the controller 102 counts time during which the motor 40 is driven to rotate in the forward direction at the washing RPM changed from the second RPM Y2' to the first RPM Y1' or third RPM Y3' and determines whether the predetermined first time t1 has passed (322).

When, as a result of the determination in operation 322, the first time t1 has not passed, the controller 102 returns to operation 320 and changes the washing RPM from the second RPM Y2' to the first RPM Y1' or third RPM Y3' to drive the motor 40 to rotate in the forward direction until the first time t1 passes.

Meanwhile, when, as a result of the determination in operation 322, the first time t1 has passed, the controller 102 stops the motor 40 by using the driver 106 (324) and counts time during which the motor 40 is stopped and determines whether the predetermined second time t2 has passed (326).

When, as a result of the determination in operation 326, the second time t2 has not passed, the controller 102 returns to operation 324 and performs subsequent operations.

Meanwhile, when, as a result of the determination in operation 326, the second time t2 has passed, the controller 102 changes the washing RPM of the motor 40 from the second RPM Y2' to the first RPM Y1' or third RPM Y3' as illustrated in FIG. 7 and drives the motor 40 to rotate in the reverse direction by using the driver 106. According to the reverse rotation drive of the motor 40, the drum 30 is rotated in the reverse direction (328).

In this case, the controller 102 counts time during which the motor 40 is driven to rotate in the reverse direction at the washing RPM changed from the second RPM Y2' to the first RPM Y1' or third RPM Y3' and determines whether the predetermined first time t1 has passed (330).

When, as a result of the determination in operation 330, the first time t1 has not passed, the controller 102 returns to operation 328 and changes the washing RPM from the second RPM Y2' to the first RPM Y1' or third RPM Y3' to drive the motor 40 to rotate in the reverse direction until the first time t1 passes.

Meanwhile, when, as a result of the determination in operation 330, the first time t1 has passed, the controller 102 stops the motor 40 by using the driver 106 (332) and counts time during which the motor 40 is stopped and determines whether the predetermined second time t2 has passed (334).

When, as a result of the determination in operation 334, the second time t2 has not passed, the controller 102 returns to operation 332 and performs subsequent operations.

Meanwhile, when, as a result of the determination in operation 334, the second time t2 has passed, the controller 102 changes the washing RPM of the motor 40 from a second RPM Y2" (a value greater than Y2', about 46 RPM) to a first RPM Y1" (a value greater than Y1', about 61 RPM) or a third RPM Y3" (a value greater than Y3', about 61 RPM) as illustrated in FIG. 7 to drive the motor 40 to rotate in the forward direction by using the driver 106 (336). In this case, the variable range from the second RPM Y2" to the first RPM Y1" or third RPM Y3" may be set to about 46 RPM to 61 RPM.

In this case, the controller 102 counts time during which the motor 40 is driven to rotate in the forward direction at the washing RPM changed from the second RPM Y2" to the first RPM Y1" or third RPM Y3" and determines whether the predetermined first time t1 has passed (338).

When, as a result of the determination in operation 338, the first time t1 has not passed, the controller 102 returns to operation 336 and changes the washing RPM from the second RPM Y2" to the first RPM Y1" or third RPM Y3" to drive the motor 40 to rotate in the forward direction until the first time t1 passes.

Meanwhile, when, as a result of the determination in operation 338, the first time t1 has passed, the controller 102 stops the motor 40 by using the driver 106 (340) and counts time during which the motor 40 is stopped and determines whether the predetermined second time t2 has passed (342).

When, as a result of the determination in operation 342, the second time t2 has not passed, the controller 102 returns to operation 340 and performs subsequent operations.

Meanwhile, when, as a result of the determination in operation 342, the second time t2 has passed, the controller 102 changes the washing RPM of the motor 40 from the second RPM Y2" to the first RPM Y1" or third RPM Y3" as illustrated in FIG. 7 and drives the motor 40 to rotate in the reverse direction by using the driver 106. According to the reverse rotation drive of the motor 40, the drum 30 is rotated in the reverse direction (344).

In this case, the controller 102 counts time during which the motor 40 is driven to rotate in the reverse direction at the washing RPM changed from the second RPM Y2" to the first RPM Y1" or third RPM Y3" and determines whether the predetermined first time t1 has passed (346).

When, as a result of the determination in operation 346, the first time t1 has not passed, the controller 102 returns to operation 344 and changes the washing RPM from the second RPM Y2" to the first RPM Y1" or third RPM Y3" to drive the motor 40 to rotate in the reverse direction until the first time t1 passes.

Meanwhile, when, as a result of the determination in operation 346, the first time t1 has passed, the controller 102 stops the motor 40 by using the driver 106 (348) and counts time during which the motor 40 is stopped and determines whether the predetermined second time t2 has passed (350).

When, as a result of the determination in operation 350, the second time t2 has not passed, the controller 102 returns to operation 348 and performs subsequent operations.

In this way, when the washing RPM of the motor 40 is changed from the second RPM (Y2→Y2'→Y2") to the first RPM (Y1→Y1'→Y1") or third RPM (Y3→Y3'→Y3") to rotate the drum 30 in the forward and reverse directions, according to the change in the washing RPM, the head drop behavior of laundry W occurs in various directions as illustrated in FIGS. 10A to 10C.

Because of the head drop behavior of the laundry W which occurs in various directions according to the change in the washing RPM, water (washing water) can be effectively infiltrated into the laundry W, and by continuously showing various washing operations (rubbing, tapping, centrifugal rotation, or the like), an effect of enhancing the visibility of washing can be felt by the user.

Meanwhile, when, as a result of the determination in operation 350, the second time t2 has passed, the controller 102 determines whether a washing time has passed (352).

When, as a result of the determination in operation 352, the washing time has not passed, the controller 102 returns to operation 304 and repeats the operation of changing the washing RPM of the motor 40 from the second RPM (Y2→Y2'→Y2") to the first RPM (Y1→Y1'→Y1") or third RPM (Y3→Y3'→Y3") to rotate the drum 30 in the forward and reverse directions until the washing time passes.

Meanwhile, when, as a result of the determination in operation 352, the washing time has passed, the controller 102 ends the washing stroke and proceeds to subsequent strokes of the washing machine 1 (specifically, the rinsing stroke and spin-drying stroke) (354).

Although an embodiment of the present disclosure has been described above using the washing stroke as an example, the present disclosure is not limited thereto. A rinsing mechanical force can be maximized using a rinsing profile, in which the cycle and size of rinsing RPM are variable, regardless of the amount of laundry or a change in the weight of the laundry due to moisture absorption of the laundry. In addition, the head drop behavior of the laundry can be diversified through the rinsing profile in which the cycle and size of rinsing RPM are variable, and in this way, by allowing water (rinsing water) to be effectively infiltrated into the laundry, the rinsing performance can be improved.

The foregoing detailed description of the present disclosure is merely illustrative. The foregoing content is intended to illustrate and describe exemplary embodiments of the present disclosure, and the present disclosure may be used in various other combinations, modifications, and environments. That is, the present disclosure may be modified or changed within the scope of the concept of the present disclosure disclosed herein, the scope equivalent to the foregoing content, and/or the scope of technology or knowledge of the art. The embodiments described above are intended to describe the best mode for implementing the technical idea of the present disclosure, and various modifications required for specific applications and uses of the present disclosure are also possible. Thus, the foregoing detailed description is not intended to limit the present disclosure to the disclosed modes. The attached claims should be interpreted as also including other modes.

The invention claimed is:

1. A control method of a washing machine including a tub configured to accommodate water, a drum rotatably installed inside the tub to accommodate laundry, and a motor configured to generate a driving force for rotating the drum, the control method comprising:

(a) in a state in which the motor is stopped, driving the motor and accelerating rotation of the motor so that a rotational speed of the motor reaches a first rotations-per-minute (RPM);

(b) in response to a first predetermined time passing, while a rotational direction of the motor is maintained, decelerating the rotation of the motor so that the rotational speed of the motor reaches a second RPM, wherein a difference between the first RPM and the second RPM is set differently according to a weight of the laundry;

(c) in response to the rotational speed of the motor reaching the second RPM, while the rotational direction of the motor is maintained, re-accelerating the rotation of the motor so that the rotational speed of the motor reaches a third RPM;

(d) stopping the motor during a motor-off time according to an operation rate;

(e) in response to a second predetermined time passing, driving the motor so that the motor rotates in a direction opposite to the rotational direction before the motor stops and accelerating rotation of the motor so that a rotational speed of the motor reaches the first RPM; and (f) performing (b) and (c), wherein the second RPM is greater than 0.

2. The control method of claim 1, wherein the first RPM and the third RPM are equal.

3. The control method of claim 1, wherein the first RPM is less than the third RPM.

4. The control method of claim 1, further comprising:

determining the weight of the laundry based on an acceleration time to reach a predetermined rotation speed during the accelerating rotation of the motor.

5. The control method of claim 1, wherein, prior to operation (d), operations (b) and (c) are repeatedly performed.

6. The control method of claim 1, wherein the first RPM is set differently according to a weight of the laundry accommodated in the drum.

7. The control method of claim 1, wherein the first RPM is set to be in a range of 40 to 60 RPM.

8. The control method of claim 1, wherein a difference between the first RPM and the second RPM is in a range of 10 to 30 RPM.

9. The control method of claim 1, wherein a time taken for the first RPM to reach the second RPM and a time taken for the second RPM to reach the third RPM are equal.

10. The control method of claim 1, wherein operations (a) to (f) are performed during a washing stroke.

11. The control method of claim 1, wherein the third RPM is greater than the first RPM.

12. The control method of claim 1, further comprising:

(g) stopping the motor during a motor-off time according to an operation rate; and (h) driving the motor so that the motor rotates in the rotational direction and accelerating rotation of the motor so that a rotational speed of the motor reaches a fourth RPM, wherein the fourth RPM is greater than the first RPM.

13. The control method of claim 12, further comprising:

(i) while the rotational direction of the motor is maintained, decelerating the rotation of the motor so that the rotational speed of the motor reaches a fifth RPM, wherein the fifth RPM is greater than the second RPM.

14. The control method of claim 13, further comprising:

(j) while the rotational direction of the motor is maintained, re-accelerating the rotation of the motor so that the rotational speed of the motor reaches a sixth RPM, wherein the sixth RPM is greater than the third RPM.

15. The control method of claim 14, wherein the sixth RPM is greater than the fourth RPM.

16. A washing machine comprising:

a tub configured to accommodate water;

a drum installed inside the tub to accommodate laundry;

a motor configured to generate a driving force for rotating the drum; and a controller configured to control a rotational speed of the drum, wherein the controller is programmed to perform:

(a) in a state in which the drum is stopped, driving the motor and accelerating rotation of the drum so that the rotational speed of the drum reaches a first RPM;

(b) in response to a first predetermined time passing, while a rotational direction of the drum is maintained, decelerating the rotation of the drum so that the rotational speed of the drum reaches a second RPM that is greater than 0;

(c) in response to the rotational speed of the motor reaching the second RPM, while the rotational direction of the drum is maintained, re-accelerating the rotation of the drum so that the rotational speed of the motor reaches a third RPM;

(d) stopping the drum during a motor-off time according to an operation rate;

(e) in response to a second predetermined time passing, driving the motor so that the drum rotates in a direction opposite to the rotational direction before the drum stops and accelerating rotation of the motor so that a rotational speed of the drum reaches the first RPM; and (f) performing operations (b) to (d), wherein a difference between the first RPM and the second RPM is set differently according to a weight of the laundry.

17. The washing machine of claim 16, wherein the first RPM and the third RPM are equal.

18. The washing machine of claim 17, wherein the first RPM is set to be in a range of 40 to 60 RPM.

19. The washing machine of claim 17, wherein a difference between the first RPM and the second RPM is set in a range of 10 to 30 RPM according to the weight of the laundry.

* * * * *